US006597122B2

(12) United States Patent
Lee et al.

(10) Patent No.: US 6,597,122 B2
(45) Date of Patent: Jul. 22, 2003

(54) APPARATUS FOR DRIVING THE ADDRESS ELECTRODE OF A PLASMA DISPLAY PANEL AND THE METHOD THEREOF

(75) Inventors: Kun-Ming Lee, Taipei (TW); Yi-Min Huang, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 0 days.

(21) Appl. No.: 10/150,956

(22) Filed: May 21, 2002

(65) Prior Publication Data

US 2002/0175630 A1 Nov. 28, 2002

(30) Foreign Application Priority Data

May 24, 2001 (TW) ..... 90112560 A

(51) Int. Cl.[7] ..... G09G 3/10

(52) U.S. Cl. ..... 315/169.3; 315/169.1; 315/169.4; 345/60

(58) Field of Search ..... 315/169.1, 169.3, 315/169.4; 313/585, 586, 587; 345/60, 76, 212, 208

(56) References Cited

U.S. PATENT DOCUMENTS 5,446,344 A * 8/1995 Kanazawa ..... 315/169.4
5,739,641 A * 4/1998 Nakamura et al. ..... 315/169.1
5,943,030 A * 8/1999 Minamibayashi ..... 345/60
6,175,193 B1 * 1/2001 Kishita et al. ..... 315/169.3

* cited by examiner

*Primary Examiner*—Don Wong
*Assistant Examiner*—Jimmy T. Vu
(74) *Attorney, Agent, or Firm*—Rabin & Berdo, P.C.

(57) ABSTRACT

An apparatus for driving an address electrode of a plasma display panel and the driving method thereof. The driving apparatus comprises a first switch coupled to the power source and the first node respectively, a first diode coupled in parallel to the first switch, a first capacitor coupled in parallel to the first switch, a second switch coupled to the first node and a ground node respectively, a second diode coupled in parallel to the second switch, a second capacitor coupled in parallel to the second switch, a third capacitor coupled to the signal control circuit in the first node, and a first inductance coupled to the third capacitor and a second node respectively.

30 Claims, 10 Drawing Sheets

APPARATUS FOR DRIVING THE ADDRESS ELECTRODE OF A PLASMA DISPLAY PANEL AND THE METHOD THEREOF

This application incorporates by reference Taiwanese application Serial No. 090112560, filed May 24, 2001.

BACKGROUND OF THE INVENTION

1. Field of the Invention

The invention relates in general to a driving apparatus and a method thereof, and in particular, to the apparatus for driving the address electrode of the plasma display panel and the method thereof.

2. Description of the Related Art

With the rapid developments in the fabrication technology of the audio/video (A/V) device, it can be foreseen that people in the future will enjoy the audio and video service with much higher performance than now. Taking the display device as an example, the conventional cathode ray tube (CRT) display device has the disadvantages of large volume, serious radiation issue, and serious image contortion and distortion at the brim region of the screen. Therefore, the conventional CRT display device certainly cannot satisfy the people who desire to enjoy the audio and video service with higher performance. When the high definition digital television (HDTV) system starts to operate and broadcast in the near future, the conventional CRT display device designed in the analog manner will gradually be obsolete. Instead, the plasma display panel (PDP), which has at least the advantages of low radiation, low power consumption, and large display area with small volume, can be a very promising product to replace the CRT display device.

FIG. 1 shows the diagram of the discharge unit of the tri-electrode alternating current plasma display panel (AC PDP). A plasma display panel includes n Y electrodes Y1~Yn, n X electrodes coupled to each other, and m address electrodes A1~Am. Each Y electrode is parallel to each X electrode respectively. A pair of the X electrode and the Y electrode is orthogonal to an address electrode to form a discharge unit, as shown in FIG. 1. Therefore, the plasma display panel includes n×m discharge units. Each discharge unit can be lighted independently.

FIG. 2 shows the cross-sectional view of one discharge unit of the tri-electrode alternating current plasma display panel (AC PDP). Each discharge unit includes an X electrode, a Y electrode and an address electrode A. The X electrode and the Y electrode are set on the front glass substrate 202 in parallel and covered by the dielectric layer 204. The dielectric layer 204 is used for accumulating wall charges. The dielectric layer 204 is covered by the protective layer 206. The protective layer 206 is used for protecting the X electrode, the Y electrode, and the dielectric layer 204. The address electrode A is set on the back glass substrate 208 opposite to the front glass substrate 202, and is orthogonal to the X electrode and the Y electrode respectively. The address electrode A is covered by the fluorescence layer 210. The rib 212 is formed along the sides of the address electrode A. The space between the protective layer 206 and the fluorescence layer 210 is the discharge space 214. The discharge space 214 is filled with the discharge gas which comprises Ne and Xe.

The disadvantages of the plasma display panel are that the power loss is huge and the electromagnetic interference (EMI) problem is serious when switching the voltage of the address electrode by the address electrode driving apparatus. There are three kinds of conventional address electrode driving apparatus called the address electrode driving apparatus, the hard switching apparatus, and the bootstrap driving apparatus respectively. Each of them will be described in the following article.

FIG. 3 shows the diagram of the conventional address electrode driving apparatus for driving the address electrode of the plasma display panel 300. The conventional address electrode driving apparatus 300 comprises four switches (M1, M2, M3, and M4), two diodes (D1 and D2), a capacitor (Cs), and an inductance (L), as shown in FIG. 3. An external power source is coupled to the conventional address electrode driving apparatus 300 for applying the driving voltage Vd. A signal control apparatus 302 is coupled to the conventional address electrode driving apparatus 300 at the node a. The plasma display panel 304 is coupled to the signal control apparatus 302. The plasma display panel is represented in the form of the equivalent circuit 304 in FIG. 3. The equivalent circuit of the plasma display panel 304 includes the equivalent capacitor between the X electrode and the address electrode Cx, the equivalent capacitor between the Y electrode and the address electrode Cy, and the equivalent capacitor between the X electrode and the Y electrode Cxy, as shown in FIG. 3.

FIG. 4 shows the timing chart of the gate to the source voltage (Vgs) of M1 ($V_{g1}$), M2 ($V_{g2}$), M3 ($V_{g3}$), and M4 ($V_{g4}$), respectively, and the voltage of the node a (Va). When applying the gate to the source voltage Vgs to the gate electrode of the switch, the switch can be turned on. And when the gate to the source voltage Vgs does not apply anymore, the switch can be turned off. The operation of the conventional address electrode driving apparatus 300 can be controlled by controlling the ON and the OFF stages of the switches M1, M2, M3, and M4 periodically. The operation of the conventional address electrode driving apparatus 300 can be divided in 5 stages according to the stage of the switches M1, M2, M3, and M4 in one period. Each stage will be described in the following article.

When $0 \leqq t \leqq t1$: 1.

When t=0, the switch M2 can be turned on and the other switches are turned off. The node a is coupled to the ground when the switch M2 is turned on. Therefore, the node a voltage Va is 0. After t=0, the switch M2 is turned off, and the voltage of node a remains 0.

When $t1 \leqq t \leqq t2$: 2.

When t=t1, the switch M3 can be turned on and the other switches are turned off. FIG. 5*a* shows the equivalent circuit of the conventional address electrode driving apparatus 300 when the switch M3 is turned on and the switches M1, M2, and M4 are turned off. The equivalent circuit of the plasma display panel 304 can be represented in the form of an equivalent capacitor Cp in FIGS. 5*a* and 5*b*. The capacitor voltage of the capacitor Cs is Vs. The capacitance of the capacitor Cs is much larger than the capacitance of the equivalent capacitor Cp. Therefore, the capacitor Cs can be regarded as a voltage source with a voltage Vs. When the switch M3 is turned on, a current I1 can flow from the capacitor Cs to the capacitor Cp through the inductance L. The capacitor Cp is charged by the current I1 and the node a voltage Va can be raised when the switch M3 is turned on, as shown in FIG. 4.

When $t2 \leqq t \leqq t3$: 3.

When t=t2, the voltage of node a is Vd and the switch M1 can be turned on. When the switch M1 is turned on, the node a is coupled to the external power source directly. Because the magnitude of the node a voltage and the applying voltage of the external power source is equaled when the switch M1 is turned on, there is no current between the external power source and the node a. Therefore, the voltage of node a is still Vd.

When $t3 \leqq t \leqq t4$: 4.

When t=t3, the switch M4 can be turned on and the other switches are turned off. FIG. 5*b* shows the equivalent circuit of the conventional address electrode driving apparatus 300 when the switch M4 is turned on and the switches M1, M2, and M3 are turned off. When the switch M4 is turned on, the capacitor Cp will be discharged and a current I2 will flow from the capacitor Cp to the capacitor Cs through the inductance L. The capacitor Cp can be in resonance with the inductance L. Therefore, the node a voltage can be lowered. When switching the voltage of the address electrode, the power is stored by the resonance between the capacitor and the inductance. In this manner, the power loss of the plasma display panel can be decreased.

When $t \geqq t4$: 5.

When t=t4, the voltage of node a is lowered to 0 and the switch M2 can be turned on again.

In this manner, the operation of the conventional address electrode driving apparatus 300 in one period has been accomplished.

FIG. 6 shows the diagram of the conventional hard switching apparatus for driving the address electrode of the plasma display panel 600. The conventional hard switching apparatus 600 includes 2 switches (M1, and M2) and a resistor (R). An external power source is coupled to the conventional hard switching apparatus 600 for applying the driving voltage Vd. A signal control apparatus 602 is coupled to the conventional hard switching apparatus 600 in the node a. The plasma display panel 604 is coupled to the signal control apparatus 602. The plasma display panel is represented in the form of the equivalent circuit 604 in FIG. 6.

FIG. 7 shows the timing chart of the gate to the source voltage (Vgs) of M1 ($V_{g1}$), and M2 ($V_{g2}$), respectively, and the voltage of the node a (Va). The operation of the conventional hard switching apparatus 600 can be controlled by controlling the ON and the OFF stage of the switches M1 and M2 periodically. The operation of the conventional hard switching apparatus 600 can be divided in 6 stages according to the stage of the switches M1 and M2 in one period. Each stage will be described in the following article.

When $0 \leqq t \leqq t1$: 1.

When $0 \leqq t \leqq t1$, the switches M1, and M2 are turned off and the node a voltage is 0.

When $t1 \leqq t \leqq t2$: 2.

The switch M1 is turned on and the switch M2 is turned off when $t1 \leqq t \leqq t2$. FIG. 8*a* shows the equivalent circuit of the conventional hard switching apparatus 600 when the switch M1 is turned on and the switch M2 is turned off. The equivalent circuit of the plasma display panel 304 can be represented in the form of an equivalent capacitor Cp in FIGS. 8*a* and 8*b*. The external power source is coupled to the node a directly. The node a voltage can be switched to Vd, no matter what it was before directly coupling to the external power source. The equivalent capacitor Cp is charged by the external power source through the current I1 flowing from the external power source to the equivalent capacitor Cp. The node a voltage can be raised to Vd when t=t2.

When $t2 \leqq t \leqq t3$: 3.

The switch M1 is still turned on and the switch M2 is still turned off when $t2 \leqq t \leqq t3$. When t=t2, the node a voltage is equaled to Vd. There is no current I1 flowing form the external power source to the equivalent capacitor Cp and the equivalent capacitor Cp is not charged by the external power source.

When $t3 \leqq t \leqq t4$: 4.

The switch M1 and M2 are turned off when $t3 \leqq t \leqq t4$. The voltage of node a is still Vd.

When $t4 \leqq t \leqq t5$: 5.

The switch M2 is turned on and the switch M1 is turned off when $t4 \leqq t \leqq t5$. FIG. 8*b* shows the equivalent circuit of the conventional hard switching apparatus 600 when the switch M2 is turned on and the switch M1 is turned off. The node a is coupled to the ground directly. The node a voltage Va can be switched to 0, no matter what it was before coupling to the ground. The equivalent capacitor Cp is discharged through the current I2 flowing from the equivalent capacitor Cp to the ground. The voltage of node a can be lowered to 0 when t=t5.

When $t5 \leqq t \leqq t6$: 6.

The switch M1 is still turned off and the switch M2 is still turned on when $t5 \leqq t \leqq t6$. When t=t6, the voltage of node a is 0. There is no current I1 flowing form the external power source to the equivalent capacitor Cp.

In this manner, the operation of the conventional hard switching apparatus 600 in one period has been accomplished.

FIG. 9 shows the diagram of the conventional bootstrap apparatus for driving the address electrode of the plasma display panel 900. The conventional bootstrap apparatus 900 includes two switches (M1 and M2), a diode (D1), a resistance (R), and a capacitor (C). The external power source is coupled to the conventional bootstrap apparatus 900 for applying the driving voltage Vd. The driving voltage of the conventional bootstrap apparatus 900 applied by the external power source can be reduced to Vd/2, instead of Vd. A signal control apparatus 902 is coupled to the conventional bootstrap apparatus 900 in the node a. The plasma display panel 904 is coupled to the signal control apparatus 902.

FIG. 10 shows the timing chart of the gate to the source voltage (Vgs) of M1 ($V_{g1}$), and M2 ($V_{g2}$), and the voltage of the node a (Va). The operation of the conventional bootstrap apparatus 900 can be controlled by controlling the ON and the OFF stage of the switches, M1 and M2, periodically. The operation of the conventional bootstrap apparatus 900 can be divided in 4 stages according to the stage of the switches M1 and M2 in one period. Each stage will be described in the following article.

When $t1 \leqq t \leqq t2$: 1.

When t=t1, the voltage of node a is 0 and the switch M2 can be turned on. Therefore, the diode D1 can be turned on because of the forward bias voltage Vd/2. The node a is coupled to the external power source directly in this manner.

The node a voltage Va can be switched to Vd/2 by the external power source. The capacitor (C) can be charged by the external power source until the capacitor voltage is Vd/2.

When $t2 \leqq t \leqq t3$: 2.

When t=t2, the node a voltage is Vd/2 and the switch M2 can be turned off. The switches M1 and M2 are turned off and the node a voltage Va is still Vd/2.

When $t3 \leqq t \leqq t4$: 3.

When t=t3, the node a voltage is Vd/2 and the switch M1 can be turned on. The node a voltage Va is switched again from Vd/2 to Vd by the external power source. The capacitor (C) can be charged continuously by a current flowing form the external power source to the capacitor (C) through the switch M1 and the resistor (R).

When $t \geqq t4$: 4.

When t=t4, the node a voltage Va is Vd and the switch M1 can be turned off. The capacitor (C) can be discharged and the node a voltage Va can be lowered to 0.

In this manner, the operation of the conventional bootstrap apparatus 900 in one period has been accomplished.

Each of the conventional address electrode driving apparatus of the plasma display panel has the following disadvantages respectively. The conventional address electrode driving apparatus needs more devices than the conventional hard switching apparatus and the conventional bootstrap apparatus. Therefore, the cost of manufacturing the conventional address electrode driving apparatus is higher than manufacturing the other two conventional address electrode driving apparatus. Since the conventional address electrode driving apparatus includes four switches, the driving method of the conventional address electrode driving apparatus is more complicated than the other two conventional address electrode driving apparatus. In addition, zero voltage switching (ZVS) is more difficult for these three conventional address electrode driving apparatus. What is called the zero voltage switching is that the drain to the source voltage ($V_{ds}$) of the switch is zero when the stage of the switch is switched. In this manner, there will be no switching current between the drain electrode and the source electrode when the stage of the switch is switched. The power loss of the switch can be decreased. In addition, the electromagnetic interference (EMI) problem would be serious if the drain to the source voltage ($V_{ds}$) of the switch is not zero as switching. Therefore, the total power loss can be decreased and the electromagnetic interference problem can be solved if the zero voltage switching can be accomplished. To sum up, the disadvantages of these three conventional address electrode driving apparatus are that the manufacturing cost is high, the driving method is complicated, the power loss is large, and the electromagnetic interference problem is serious.

The device needed is one in which the manufacturing cost is lower and the driving method is easier when comparing the conventional hard switching apparatus to the conventional address electrode driving apparatus. Additionally, the conventional hard switching apparatus must serially connect to the resistor (R) in order to adjust the rising time and the falling time of the node a voltage. Therefore, there will be a current flowing through the resistor (R) when the node a voltage Va is changed. The power loss is increased in the form of dissipating heat. The operation temperature can be increased in this manner. Therefore, the operation of the plasma display panel can be affected.

The driving voltage applied by the external power source in the conventional bootstrap apparatus is only a half of the other two conventional address electrode driving apparatus. However, zero voltage switching cannot be accomplished, and the power loss and the electromagnetic interference cannot be avoided when operating the conventional bootstrap apparatus. In addition, the conventional bootstrap apparatus also includes a resistor (R). Therefore, the power loss in the form of dissipating heat is increased also. The operation of the plasma display panel can be affected in this manner.

SUMMARY OF THE INVENTION

It is therefore an object of the invention to provide an improved and simplified apparatus for driving the address electrode of the plasma display panel so as to achieve the following objectives: first, to decrease the cost of the driving apparatus; second, to simplify the driving method of the driving apparatus; third, to decrease the power loss of the driving apparatus; and fourth, to decrease the problem of electromagnetic interference.

The invention achieves the above-identified objects by providing a new apparatus for driving the address electrode of the plasma display panel and the method thereof. The driving apparatus is coupled to a signal control circuit of the address electrode in a first node. Additionally, a power source for applying a driving voltage is coupled to the driving apparatus. The driving apparatus comprises a first switch, a first diode, a first capacitor, a second switch, a second diode, a second capacitor, a third capacitor, and a first inductance. The first switch is coupled to the power source and the first node, respectively. The first diode is coupled in parallel to the first switch. The first capacitor is coupled in parallel to the first switch. The second switch is coupled to the first node and a ground node, respectively. The second diode is coupled in parallel to the second switch. The second capacitor is coupled in parallel to the second switch. The third capacitor is coupled to the second node and the first node. The first inductance is coupled to the third capacitor and a second node, respectively.

BRIEF DESCRIPTION OF THE DRAWINGS

Other objects, features, and advantages of the invention will become apparent from the following detailed description of the preferred but non-limiting embodiments. The description is made with reference to the accompanying drawings in which:

FIG. 13*b* illustrates the equivalent circuit of the address electrode driving apparatus of the plasma display panel according to the preferred embodiment of the present invention when the switches M1 and M2 are turned off and the inductance current flows from the node b to the node a;

DESCRIPTION OF THE PREFERRED EMBODIMENT

Figure 1:
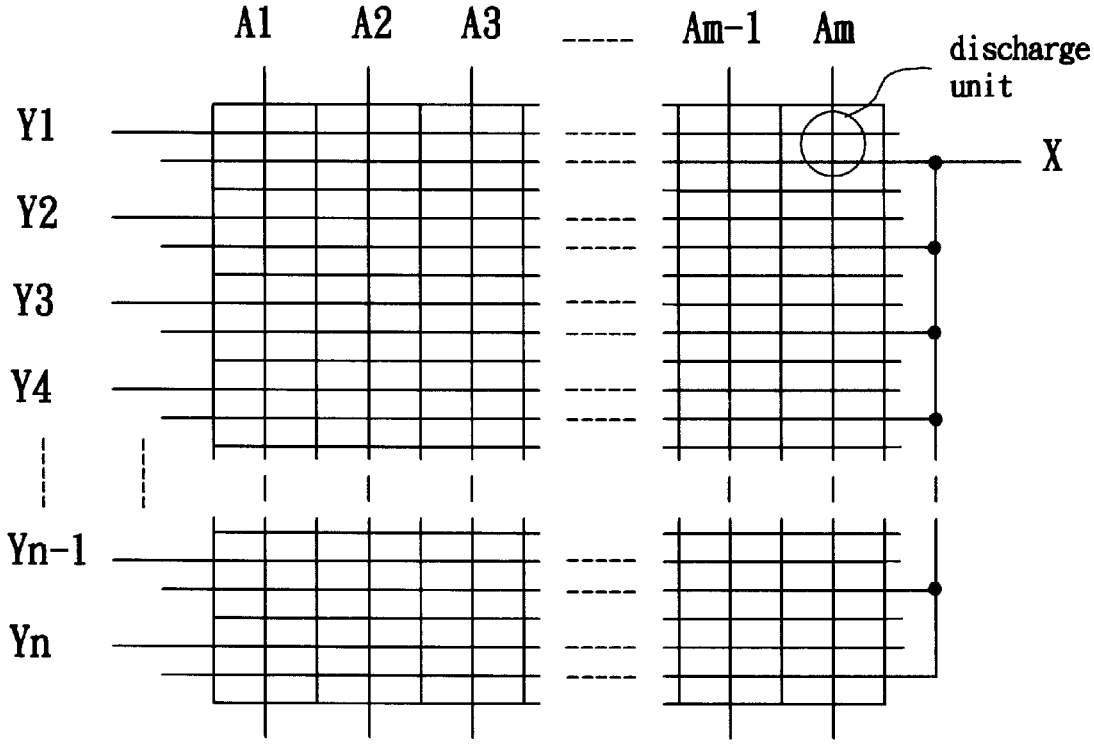
FIG. 1 (PRIOR ART)
FIG. 1 (Prior Art) illustrates a diagram of the discharge unit of the tri-electrode alternating current plasma display panel.
Figure 2:
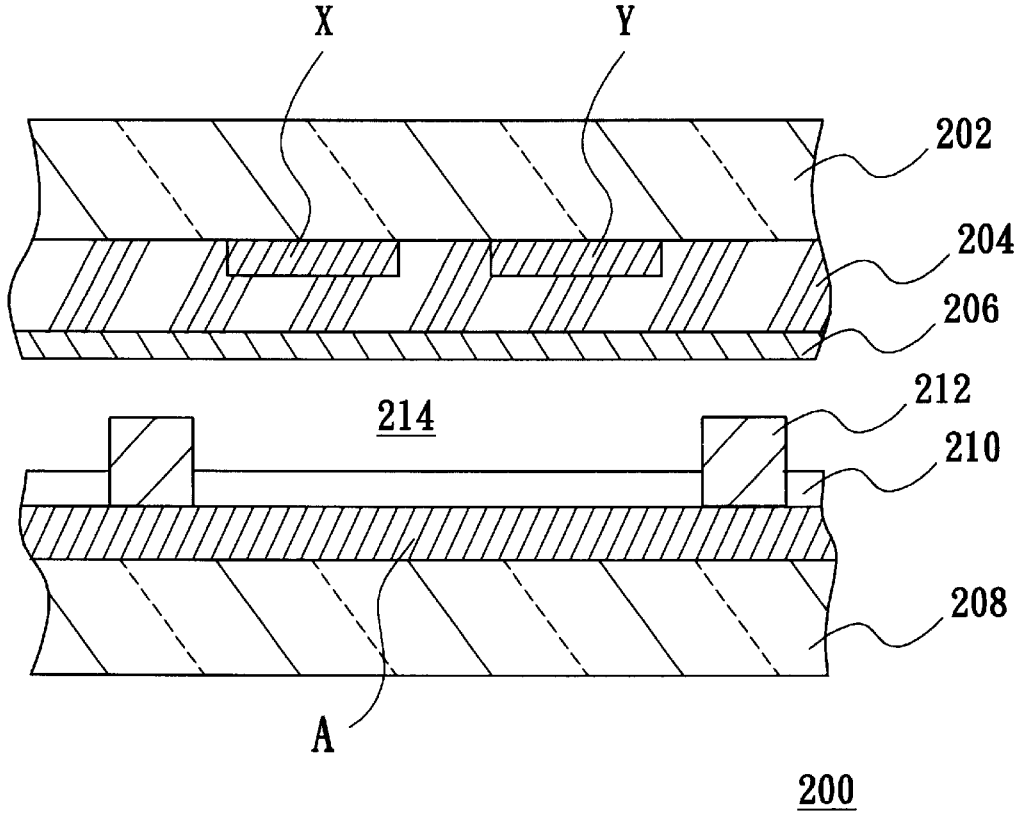
FIG. 2 (PRIOR ART)
FIG. 2 (Prior Art) illustrates the cross-sectional view of the discharge unit of the tri-electrode alternating current plasma display panel.
Figure 3:
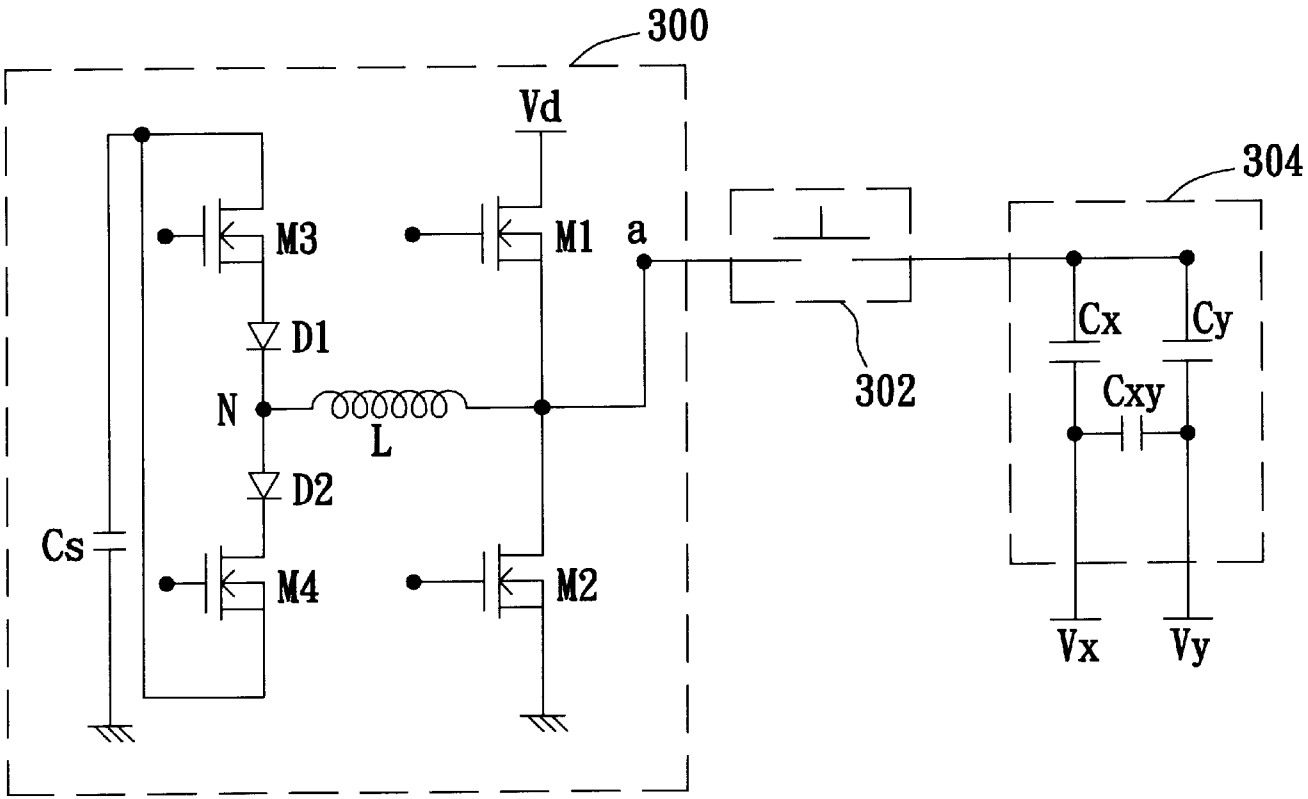
FIG. 3 (PRIOR ART)
FIG. 3 (Prior Art) illustrates a diagram of the conventional address electrode driving apparatus for driving address electrode of the plasma display panel.
Figure 4:
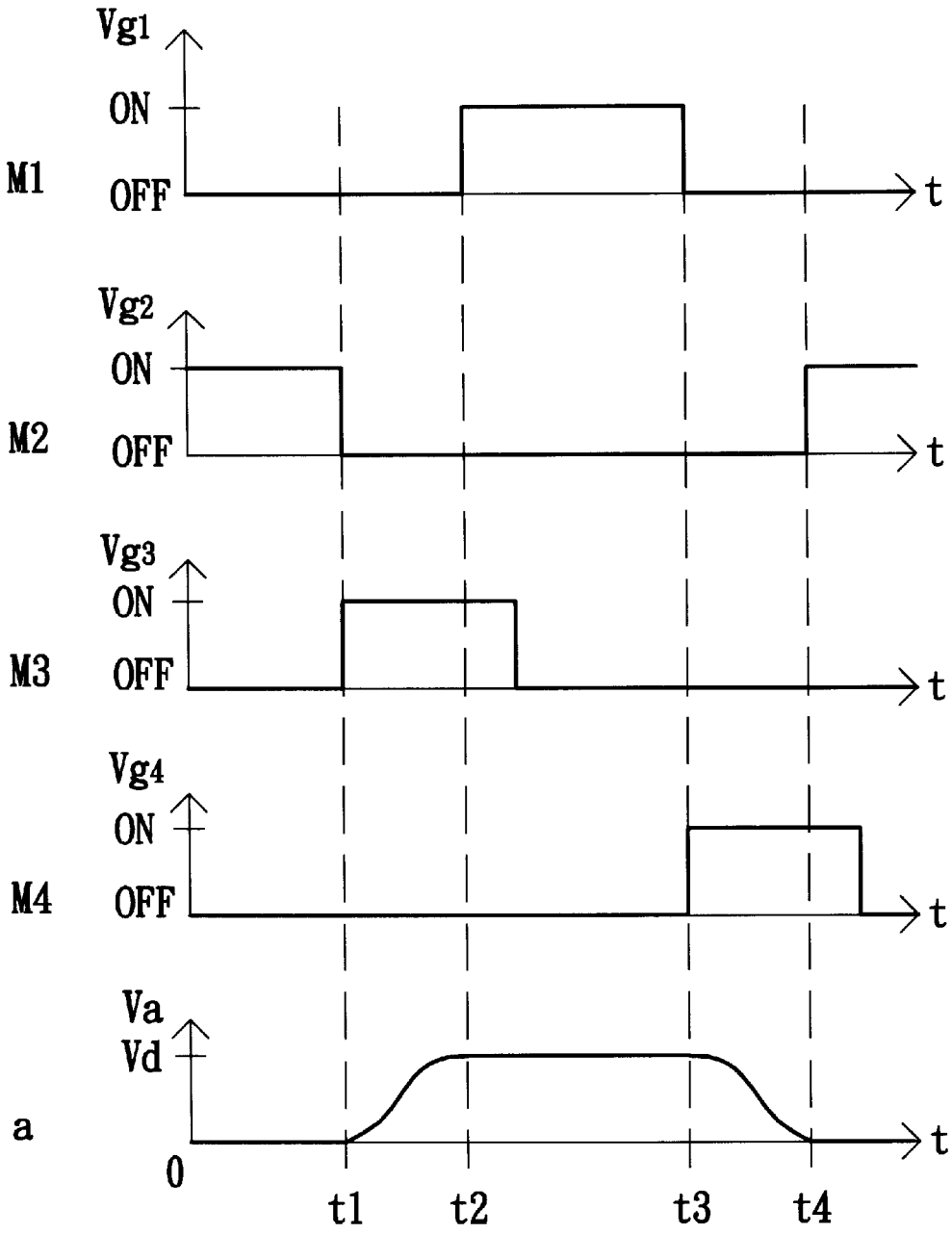
FIG. 4 (PRIOR ART)
FIG. 4 (Prior Art) illustrates the timing chart of the gate to the source voltage (Vgs) of M1 ($V_{g1}$), M2 ($V_{g2}$), M3 ($V_{g3}$), and M4 ($V_{g4}$) respectively and the voltage of the node a (Va)
Figure 5A:
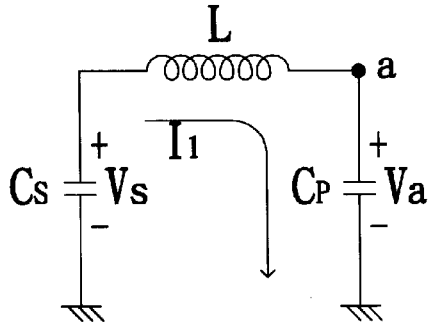
FIG. 5a (PRIOR ART)
FIG. 5*a* (Prior Art) illustrates the equivalent circuit of the conventional address electrode driving apparatus when the switch M3 is turned on and the switches M1, M2, and M4 are turned off.
Figure 5B:
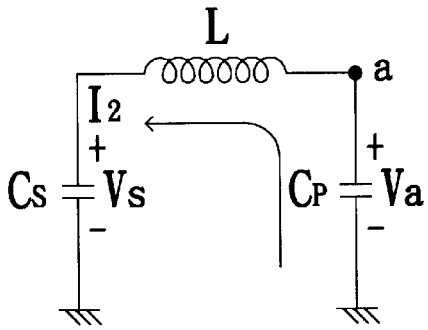
FIG. 5b (PRIOR ART)
FIG. 5*b* (Prior Art) illustrates the equivalent circuit of the conventional address electrode driving apparatus when the switch M4 is turned on and the switches M1, M2, and M3 are turned off.
Figure 6:
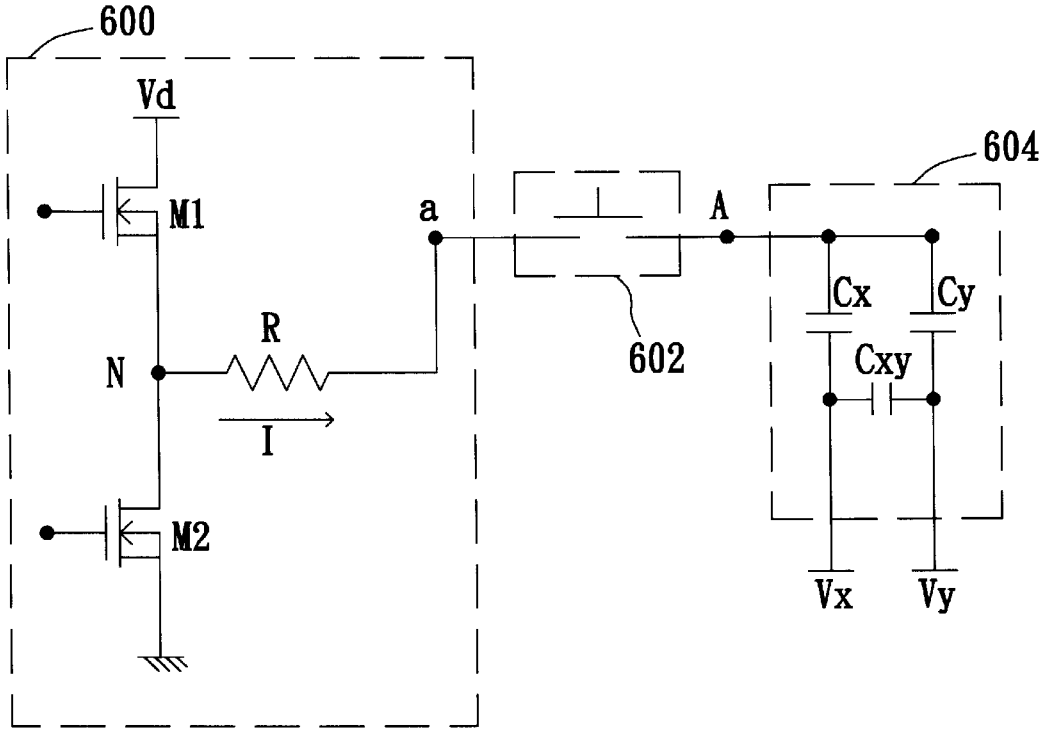
FIG. 6 (PRIOR ART)
FIG. 6 (Prior Art) illustrates a diagram of the conventional hard switching apparatus for driving the address electrode of the plasma display panel.
Figure 7:
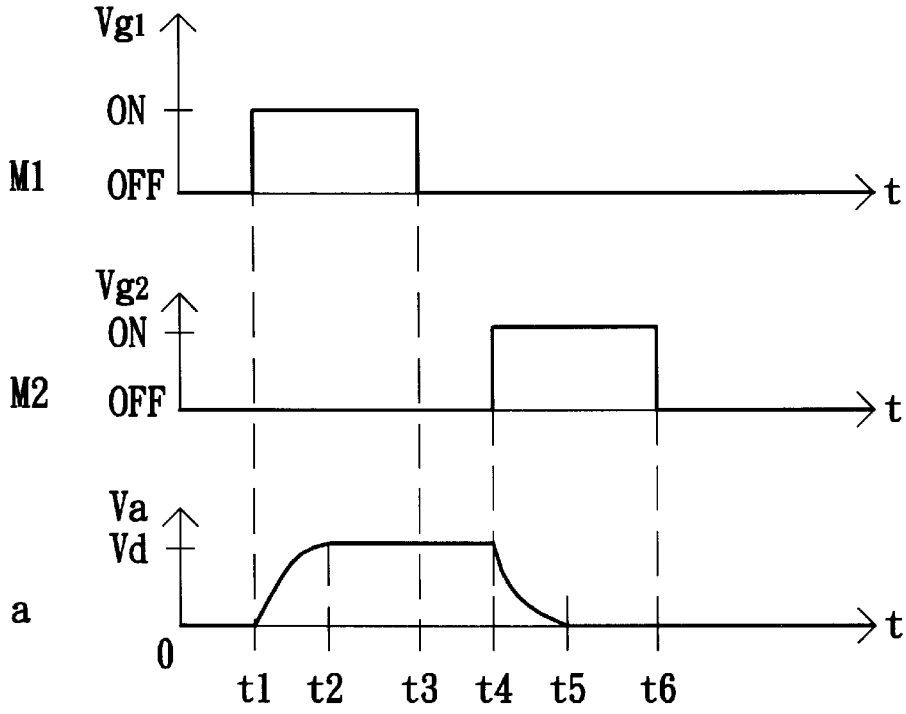
FIG. 7 (PRIOR ART)
FIG. 7 (Prior Art) illustrates the timing chart of the gate to the source voltage (Vgs) of M1 ($V_{g1}$), and M2 ($V_{g2}$), respectively, and the voltage of the node a (Va)
Figure 8A:
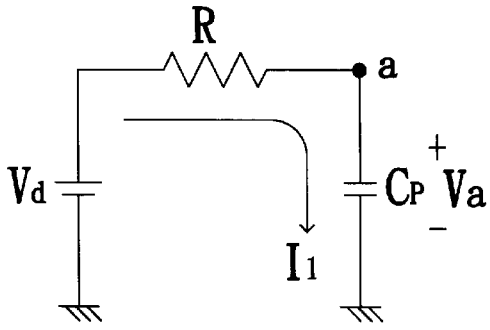
FIG. 8a (PRIOR ART)
FIG. 8*a* (Prior Art) illustrates the equivalent circuit of the conventional hard switching apparatus when the switch M1 is turned on and the switch M2 is turned off.
Figure 8B:
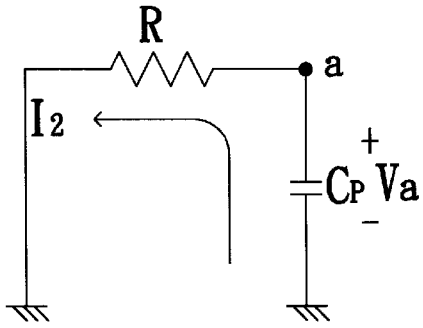
FIG. 8b (PRIOR ART)
FIG. 8*b* (Prior Art) illustrates the equivalent circuit of the conventional hard switching apparatus when the switch M2 is turned on and the switch M1 is turned off, FIG. 9 (Prior Art) illustrates a diagram of the conventional bootstrap apparatus for driving the address electrode of the plasma display panel.
Figure 9:
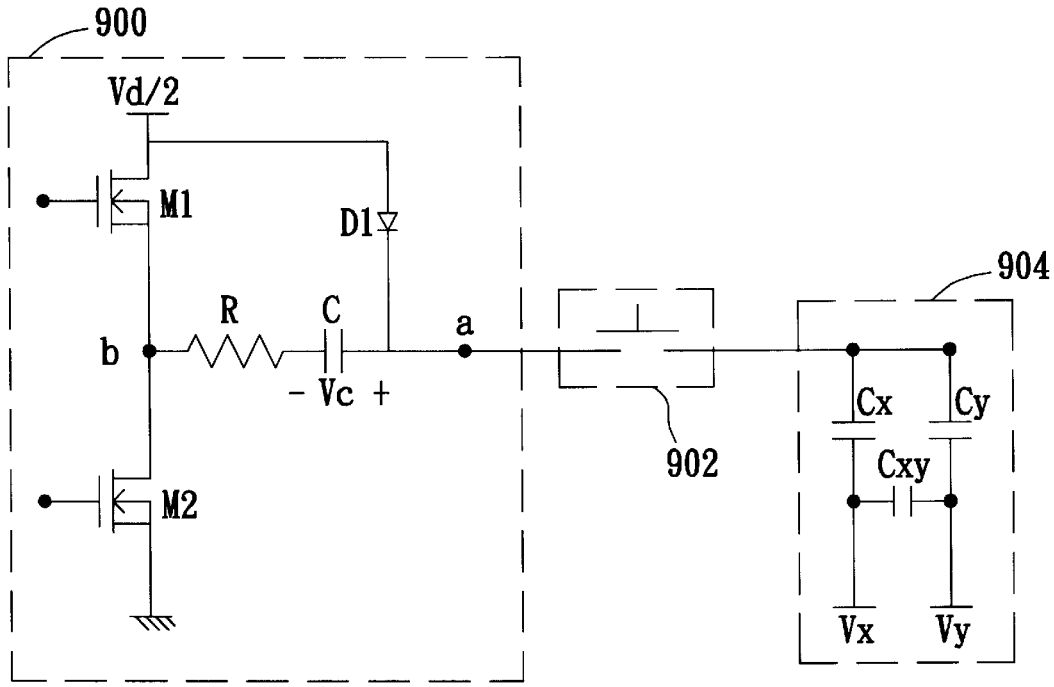
FIG. 9 (PRIOR ART)
Figure 10:
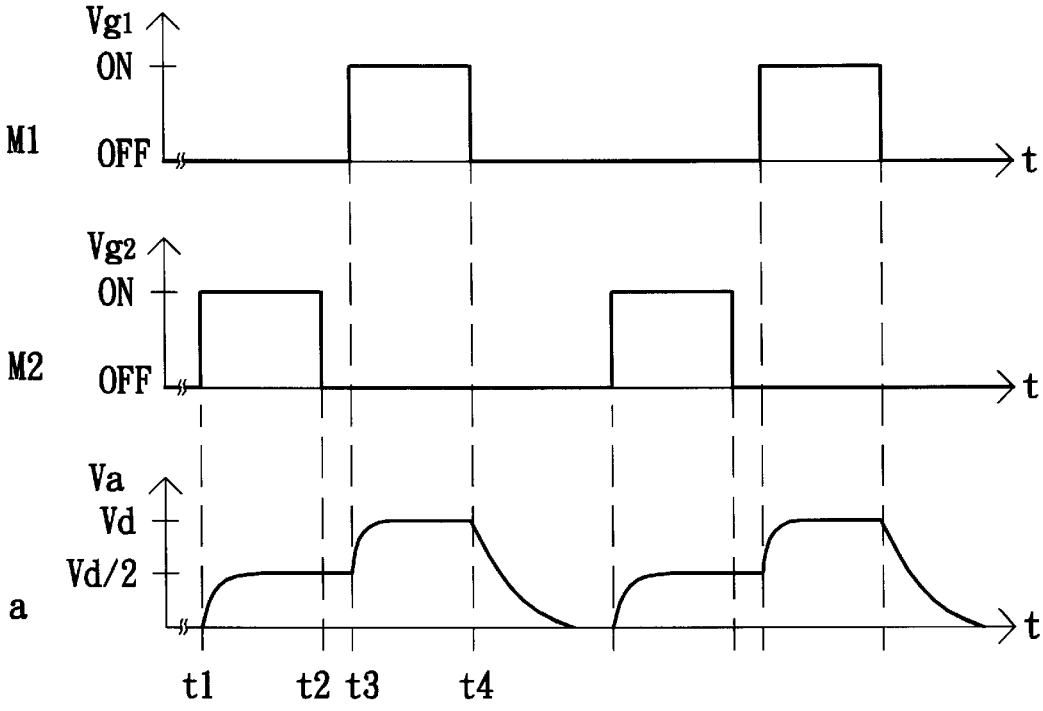
FIG. 10 (PRIOR ART)
FIG. 10 (Prior Art) illustrates the timing chart of the gate to the source voltage (Vgs) of M1 ($V_{g1}$), and M2 ($V_{g2}$), respectively, and the voltage of the node a (Va)
Figure 11:
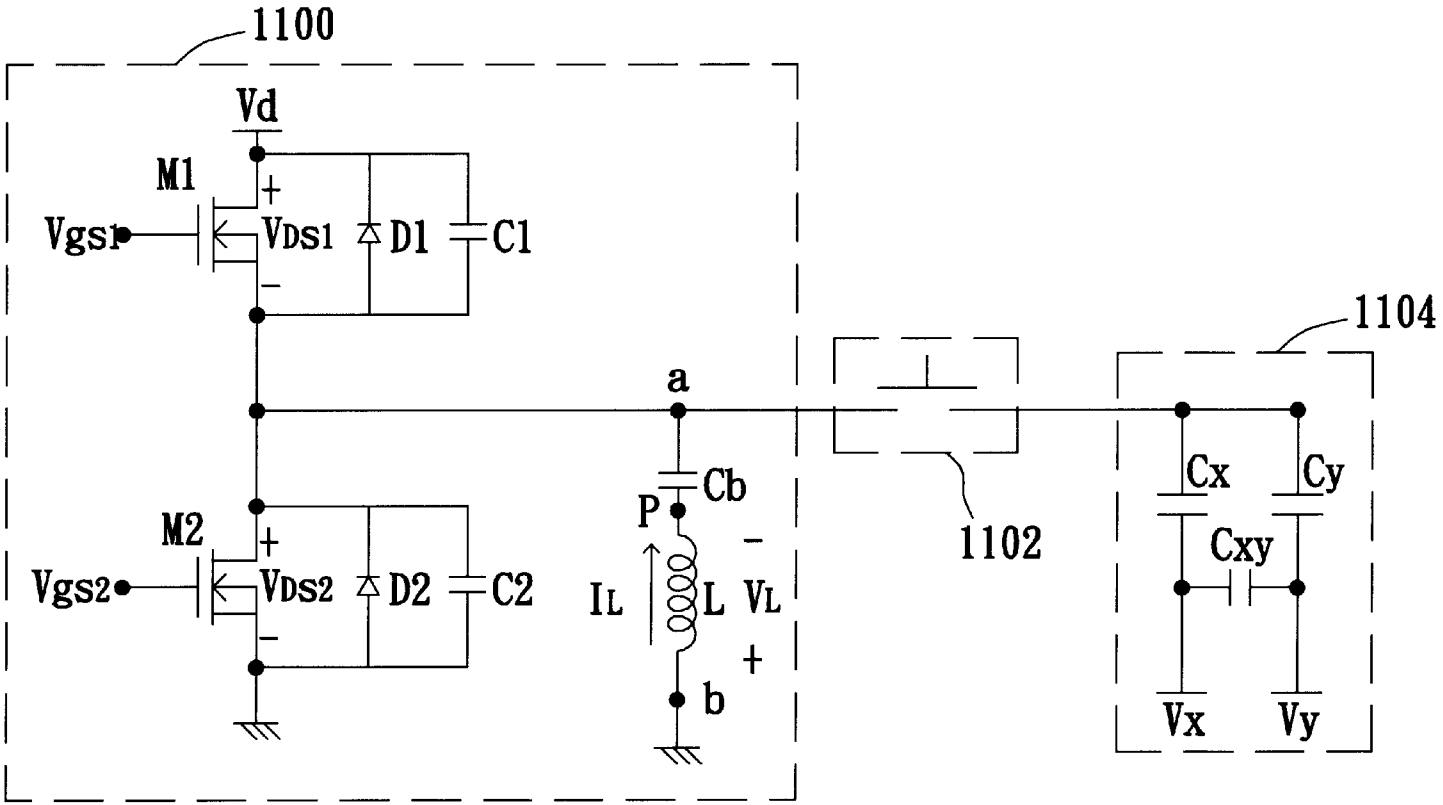
FIG. 11 illustrates a diagram of the apparatus for driving the address electrode of the plasma display panel according to the preferred embodiment of the present invention.

FIG. 11 shows a diagram of the apparatus for driving the address electrode of the plasma display panel 1100 according to the preferred embodiment of the present invention. The address electrode driving apparatus 1100 includes two switches (M1 and M2), two diodes (D1 and D2), three capacitors (C1, C2, and Cb), and an inductance (L). The switches M1 and M2 can be either n-channel metal-oxide semiconductor field-effect transistors (n-MOSFET) or p-channel metal-oxide semiconductor field-effect transistors (p-MOSFET). In this embodiment, the switch M1 is an n-MOSFET. The drain electrode of the switch M1 is coupled to the external power source and the source electrode of the switch M1 is coupled to the drain electrode of the switch M2 in the node a. The switch M1, the diode D1, and the capacitor C1 are coupled to each other in parallel between the external power source and the node a. The anode of the diode D1 is coupled to the source electrode of the switch M1 and the cathode of the diode D1 is coupled to the drain electrode of the switch M1, respectively. The switch M2 is also an n-MOSFET. The source electrode of the switch M2 is coupled to the ground and the drain electrode of the switch M2 is coupled to the source electrode of the switch M1 in the node a. The switch M2, the diode D2, and the capacitor C2 are coupled to each other in parallel between the ground and the node a. The anode of the diode D2 is coupled to the source electrode of the switch M2 and the cathode of the diode D2 is coupled to the drain electrode of the switch M2, respectively. The capacitor Cb is coupled to the node a and the inductance L, respectively. The inductance L is coupled to the capacitor Cb and the ground, respectively. The diodes D1 and D2 can be the body diodes of the switches M1 and M2 or the independent electric devices coupled to the switches M1 and M2, respectively. The capacitor C1, and C2 can be the body capacitors of the switches M1 and M2 or the independent electric devices coupled to the switches M1 and M2, respectively. A signal control apparatus 1102 is coupled to the address electrode driving apparatus of the present invention 1100 in the node a. The plasma display panel 1104 is coupled to the signal control apparatus 1102. The plasma display panel is represented in the form of the equivalent circuit 1104 in FIG. 11.

Figure 12:
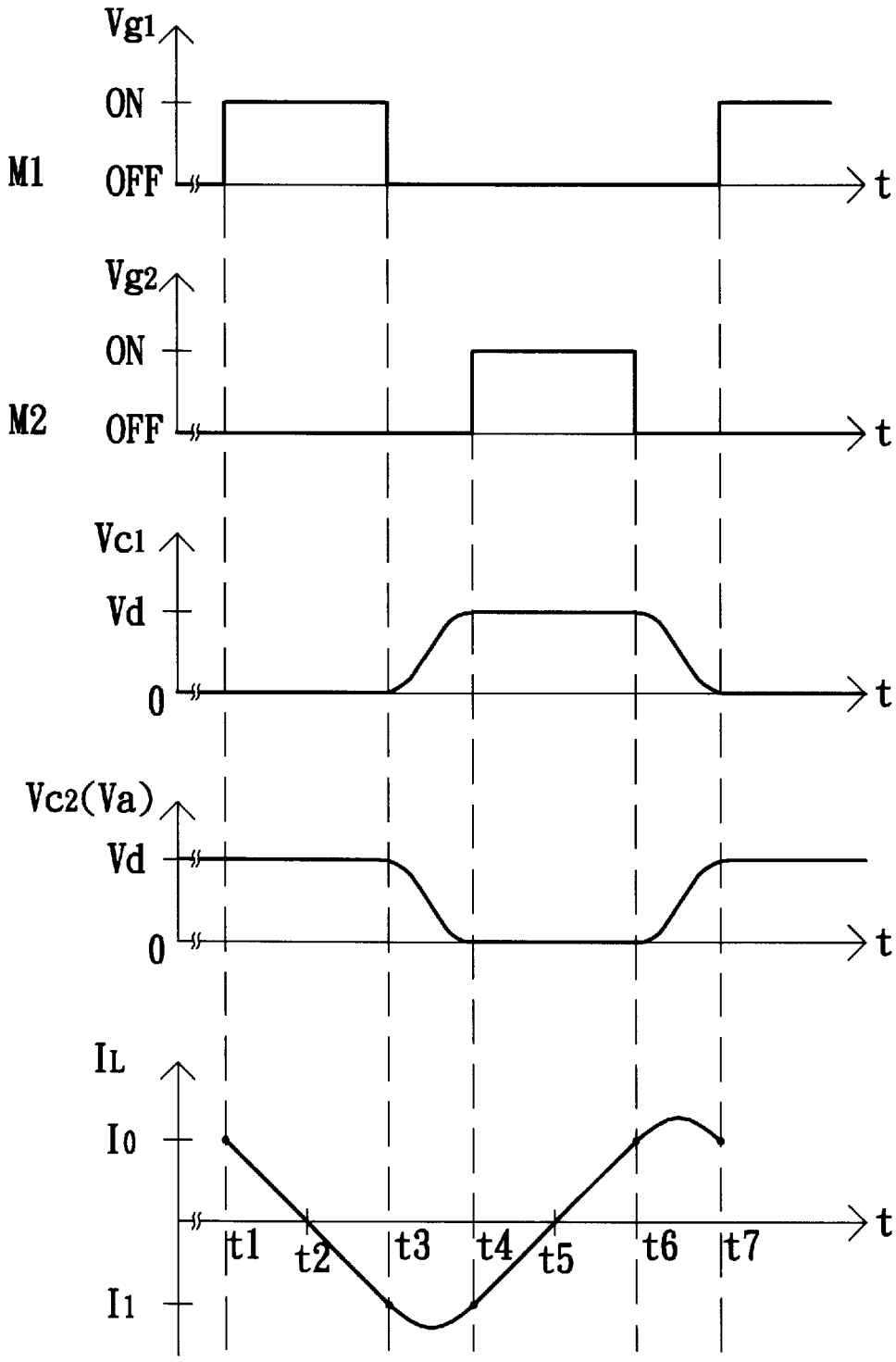
FIG. 12 illustrates the timing chart of the gate to the source voltage (Vgs) of M1 ($V_{g1}$), and M2 ($V_{g2}$), the voltage of the capacitor C2 (Vc2), the voltage of the node a (Va), and the current of the inductance L ($I_L$) of the address electrode driving apparatus of the plasma display panel according to the preferred embodiment of the present invention.

FIG. 12 shows the timing chart of the gate to the source voltage (Vgs) of M1 (Vg1), and M2 (Vg2), the voltage of the capacitor C2 (Vc2), the voltage of the node a (Va), and the current of the inductance L (IL) of the address electrode driving apparatus of the plasma display panel according to the preferred embodiment of the present invention. In this embodiment, the direction of the inductance current IL is defined to be positive when the inductance current IL flows from the node b to the node p. Thus, the direction of the inductance current IL is defined to be negative when the inductance current IL flows from the node p to the node b. The inductance voltage VL is defined to be the potential difference between the node p voltage Vp and the node b voltage Vb. The inductance voltage VL is defined to be positive when the node b voltage Vb is larger than the node p voltage Vp and the inductance voltage VL is defined to be negative when the node p voltage Vp is larger than the node b voltage Vb. The operation of the address electrode driving apparatus of the present invention 1100 can be divided in 4 stages according to ON or OFF stage of the switches M1 and M2 periodically in one period. Each stage will be described in the following article. The capacitance of the capacitor Cb is much larger than the capacitance of the capacitors C1 and C2, respectively. Therefore, the capacitor Cb can be regarded as the voltage source with the voltage Vcb. The capacitor voltage Vcb is defined to be positive when the voltage of the side of the capacitor Cb coupled to the node a is larger than the voltage of the side of the capacitor Cb coupled to the inductance L.

When $t1 \leqq t \leqq t3$: 1.

Figure 13A:
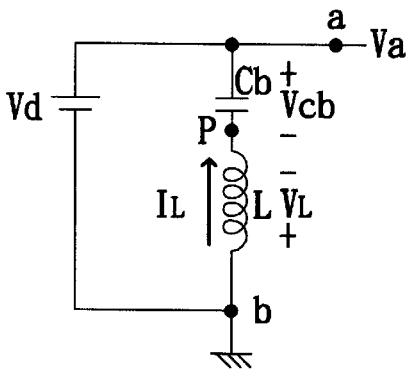
FIG. 13*a* illustrates the equivalent circuit of the address electrode driving apparatus of the plasma display panel according to the preferred embodiment of the present invention when the switch M1 is turned on and the switch M2 is turned off.

FIG. 13*a* shows the equivalent circuit of the address electrode driving apparatus according to the preferred embodiment of the present invention when the switch M1 is turned on and the switch M2 is turned off. At this time, the node a voltage Va is equaled to the external power source voltage Vd. The capacitor voltage Vcb and the inductance voltage VL are fixed. The capacitor voltage Vcb is positive and the inductance voltage VL is negative when $t1 \leqq t \leqq t3$. Therefore, the magnitude of the inductance current IL must be decreased in a fixed rate in order to maintain the fixed negative voltage VL of the inductance L, as shown in FIG. 12.

When $t3 \leqq t \leqq t4$: 2.

Figure 13B:
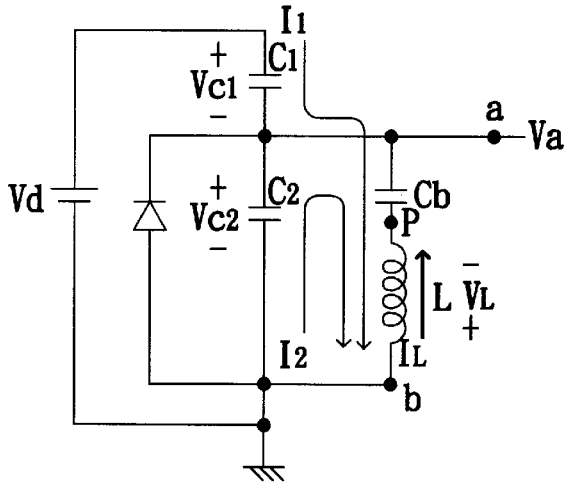

FIG. 13*b* shows the equivalent circuit of the address electrode driving apparatus according to the preferred embodiment of the present invention when the switches M1 and M2 are turned off and the inductance current IL flows from the node p to the node b, that is, the value of IL is negative. When the switch M1 and M2 are turned off, the sum of the voltage capacitor C1 (VC1) and the voltage of the capacitor C2 (VC2) is equaled to the external power source voltage Vd. The inductance current IL still flows from the node p to the node b due to the continuity of the current flow. Because of the device characteristic of the capacitors C1 and C2, and the inductance L, the capacitors C1 and C2 can be in resonance with the inductance L, respectively. There are currents I1 and I2 flowing from the capacitors C1 and C2 to the inductance L respectively, as shown in FIG. 13*b*. The capacitor C1 is charged by the current I1 and the capacitor voltage VC1 can be pulled up. The capacitor C2 is discharged by the current I2 and the capacitor voltage VC2 can be decreased. Therefore, the node a voltage Va can be decreased from Vd when $t3 \leqq t \leqq t4$.

When t=t4, the capacitor voltage VC2 and the node a voltage Va are 0, and the capacitor voltage VC1 is equaled to the external power source voltage Vd. The switch M2 can be turned on at this moment.

When $t4 \leqq t \leqq t6$: 3.

Figure 13C:
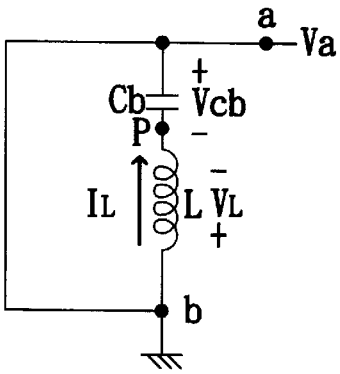
FIG. 13*c* illustrates the equivalent circuit of the address electrode driving apparatus of the plasma display panel according to the preferred embodiment of the present invention when the switch M2 is turned on and the switch M1 is turned off.

FIG. 13*c* shows the equivalent circuit of the address electrode driving apparatus according to the preferred embodiment of the present invention when the switch M2 is turned on and the switch M1 is turned off. When t=t4, the node a voltage is decreased to 0 and the diode D2 is turned on. The equivalent circuit of the address electrode driving apparatus 1100 is shown in FIG. 13*c*. The capacitor Cb can be regarded as the stable voltage source with the voltage Vcb when $t4 \leqq t \leqq t6$. The capacitor voltage Vcb is positive and the inductance voltage VL is positive when $t4 \leqq t \leqq t6$. Therefore, the magnitude of the inductance current IL must be increased in a fixed rate in order to maintain the fixed positive voltage of the inductance L, as shown in FIG. 12.

When $t4 \leqq t \leqq t5$, the direction of the inductance current IL is negative, the diode D2 can be turned on and the drain to the source voltage of the switch M2 is fixed to 0. Therefore, zero voltage switching (ZVS) can be accomplished when the switch M2 is turned on during this period. The power loss and the electromagnetic interference problem (EMI) can be reduced in this manner. In addition, the switching time of the switch M2 is not necessarily fixed in a specific moment. Anytime is allowable, when $t4 \leqq t \leqq t5$. Therefore the driving method can be simplified in the present invention.

When $t4 \leqq t \leqq t5$, the direction of the inductance current IL remains negative and the magnitude of the inductance current IL increases at a fixed rate in order to maintain the fixed positive voltage of the inductance L. When t=t5, the magnitude of the inductance current IL is 0. When $t5 \leqq t \leqq t6$, the direction of the inductance current IL is changed from negative to positive, and the magnitude of the inductance current IL still increases at the fixed rate. When t=t6, the direction of the inductance current IL is positive and the magnitude of the inductance current IL is I0. The node a voltage Va is unchanged and equaled to 0 when $t4 \leqq t \leqq t6$.

When $t6 \leqq t \leqq t7$: 4.

Figure 13D:
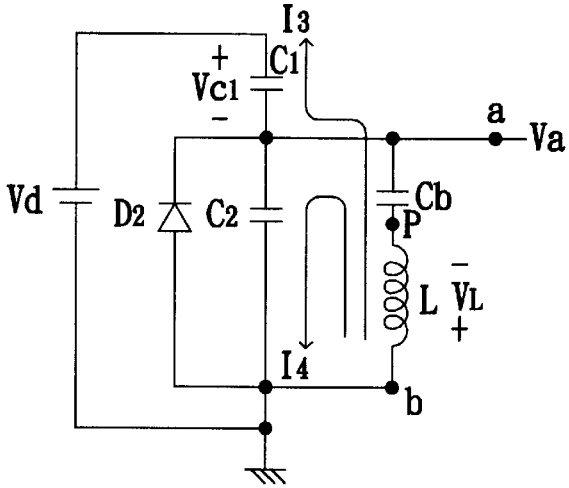
FIG. 13*d* illustrates the equivalent circuit of the address electrode driving apparatus of the plasma display panel according to the preferred embodiment of the present invention when the switches M1 and M2 are turned off and inductance current flows from the node a to the node b.

FIG. 13*d* shows the equivalent circuit of the address electrode driving apparatus according to the preferred embodiment of the present invention when the switches M1 and M2 are turned off and the inductance current IL flows from the node b to the node p. The switches M1 and M2 are turned off when t=t6. When $t6 \leqq t \leqq t7$, the sum of the capacitor voltage VC1 and the capacitor voltage VC2 is equaled to the external power source voltage Vd. The inductance current IL still flows from the node b to the node a due to the continuity of current flow. Because of the device characteristic of the capacitors C1 and C2, and the inductance L, the capacitors C1 and C2 can be in resonance with the inductance L respectively. There are currents 13 and 14 flowing from the capacitors C1 C2 to the inductance L respectively, as shown in FIG. 13*d*. The capacitor C2 is charged by the current I4 and the capacitor voltage VC2 can be raised. The capacitor C1 is discharged by the current I3 and the capacitor voltage VC1 can be decreased. Therefore, the node a voltage Va can be raised from 0 to Vd when $t6 \leqq t \leqq t7$.

When $t6 \leqq t \leqq t7$, the capacitors C1 and C2 can be in resonance with the inductance L respectively. The capacitor voltage VC2 and the node a voltage Va are increased along with an increase of current I4, shown in FIG. 13*d*. The capacitor voltage VC1 is decreased along with the decrease of the current I3 shown in FIG. 13*d*. When t=t7 the capacitor voltage VC1 is 0, and the capacitor voltage VC1 and the node a voltage Va are equaled to the external power source voltage Vd. Therefore, the node a voltage Va is raised from 0 to Vd when $t6 \leqq t \leqq t7$.

When $t1 \leqq t \leqq t3$: 5.

the waveform is repetitive, that is, the waveform at t=t7 is repeated at t=t1.

When $t1 \leqq t \leqq t2$, the direction of the inductance current IL is positive, the diode D1 can be turned on and the drain to the source voltage of the switch M1 is fixed to 0. Therefore, zero voltage switching (ZVS) can be accomplished when the switch M1 is turned on when $t1 \leqq t \leqq t2$. The power loss and the electromagnetic interference (EMI) problem can be reduced in this manner. Additionally, the switching time of the switch M1 is not necessarily fixed in a specific time. Anytime is allowable when $t1 \leqq t \leqq t2$. Therefore, the driving method can be more simplified than the conventional driving method.

As shown in FIG. 12, when t=t1, the direction of the inductance current IL is positive and the magnitude of the inductance current IL is I0. When $t1 \leqq t \leqq t2$, the direction of the inductance current IL remains positive and the magnitude of the inductance current IL is decreased in a fixed rate in order to maintain the fixed negative voltage VL of the inductance L. When t=t2, the magnitude of the inductance current IL is I0. When $t2 \leqq t \leqq t3$, the direction of the inductance current IL is changed from positive to negative and the magnitude of the inductance current IL is still decreased in the fixed rate. When t=t3, the direction of the inductance current IL is negative and the magnitude of the inductance current IL is I1. The node a voltage Va is unchanged and equaled to the external power source voltage Vd when $t1 > t > t3$.

In this manner, the operation of the address driving apparatus 1100 has been accomplished in one period.

The apparatus for driving the address electrode of the plasma display panel and the driving method thereof disclosed herein have the following advantages. First, the address electrode driving apparatus of the present invention includes only two switches. In addition, the two diodes of the address electrode driving apparatus of the present invention can be the body diodes of the corresponding switch respectively, and two of the three capacitors of the address electrode driving apparatus of the present invention can be the body capacitors of the corresponding switch, respectively. Therefore, the structure of the address electrode driving apparatus of the present invention is much simpler than that of the conventional address electrode driving apparatus. Thus the cost of manufacturing can be decreased. Second, the address electrode driving apparatus of the present invention can be operated by controlling the stage of only two switches. In addition, the switching time of each switch is not necessarily fixed in a specific time. Therefore, the driving method can be much simplified. Third, each switch of the address electrode driving apparatus of the present invention is switched by way of zero voltage switching. In addition, the address electrode driving apparatus of the present invention does not include any resistor. Therefore, the loss of power and the problem of heat dissipation can be improved. Additionally, the magnitude of the node a voltage is changed in a much smoother way. Therefore, the problem of electromagnetic interference can be improved.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An apparatus for driving an address electrode of a plasma display panel (PDP), wherein the driving apparatus is coupled to a signal control circuit of the address electrode in a first node, and a power source for applying a driving voltage is coupled to the driving apparatus, the driving apparatus comprising:

a first switch coupled to the power source and the first node respectively;

a first diode coupled in parallel to the first switch;

a first capacitor coupled in parallel to the first switch;

a second switch coupled to the first node and a ground node respectively;

a second diode coupled in parallel to the second switch;

a second capacitor coupled in parallel to the second switch;

a third capacitor coupled to the signal control circuit in the first node; and a first inductance coupled to the third capacitor and a second node respectively.

2. The apparatus according to claim 1, wherein the first switch and the second switch are both transistors.

3. The apparatus according to claim 2, wherein the first switch is a n-channel metal-oxide semiconductor field-effect transistor (MOSFET).

4. The apparatus according to claim 3, wherein the drain electrode of the first switch is coupled to the power source and the source electrode of the first switch is coupled to the second switch in the first node.

5. The apparatus according to claim 2, wherein the second switch is a n-channel metal-oxide semiconductor field-effect transistor (MOSFET).

6. The apparatus according to claim 5, wherein the drain electrode of the second switch is coupled to the ground node and the source electrode of the second switch is coupled to the first switch in the first node.

7. The apparatus according to claim 1, wherein the first diode is a body diode of the first switch.

8. The driving apparatus according to claim 1, wherein the anode of the first diode is coupled to the source electrode of the first switch and the cathode of the first diode is coupled to the drain electrode of the first switch.

9. The apparatus according to claim 1, wherein the second diode is a body diode of the second switch.

10. The apparatus according to claim 1, wherein the anode of the second diode is coupled to the drain electrode of the first switch and the cathode of the first diode is coupled to the source electrode of the first switch.

11. The apparatus according to claim 1, wherein the first capacitor is the body capacitor of the first switch.

12. The apparatus according to claim 1, wherein the first capacitor is coupled to the source electrode and the drain electrode of the first switch respectively.

13. The apparatus according to claim 1, wherein the second capacitor is the body capacitor of the second switch.

14. The apparatus according to claim 1, wherein the second capacitor is coupled to the source electrode and the drain electrode of the second switch respectively.

15. The apparatus according to claim 1, wherein the capacitance of the third capacitor is larger than the capacitance of the first and the second capacitor.

16. The apparatus according to claim 1, wherein the second node is the ground.

17. An apparatus for driving an address electrode of the plasma display panel, wherein the driving apparatus is coupled to a signal control circuit of the address electrode in a first node and a power source for applying a driving voltage is coupled to the driving apparatus, the driving apparatus comprising:

a first switch device coupled to the power source and the first node respectively;

a second switch device coupled to the first node and a ground node respectively;

a first capacitor coupled to the signal control circuit in the first node; and a first inductance coupled to the first capacitor and a second node respectively.

18. The apparatus according to claim 1, wherein the first switch device includes a first switch, a first diode and a first capacitor coupled to each other in parallel.

19. The apparatus according to claim 18, wherein the first switch is a transistor.

20. The apparatus according to claim 17, wherein the second switch device includes a second switch, a second diode and a second capacitor coupled to each other in parallel.

21. The apparatus according to claim 17, wherein the second switch is a transistor.

22. A method for driving an address electrode of a plasma display panel (PDP), wherein the method is in use for controlling an apparatus for driving the address electrode of the plasma display panel, the driving apparatus is coupled to a signal control circuit of the address electrode in a first node, and a power source for applying a driving voltage is coupled to the driving apparatus, the driving apparatus comprising:

a first switch device coupled to the power source and the first node respectively;

a second switch device coupled to the first node and a ground node respectively;

a first capacitor coupled to the signal control circuit in the first node; and a first inductance coupled to the first capacitor and a second node respectively;

wherein the first capacitor has a capacitor voltage, the first node has a first node voltage and the first inductance has a inductance current, the method comprising the steps of:

turning on the first switch when the capacitor voltage is a first voltage and the inductance current is larger than 0;

turning off the first switch when the first switch is turned on for a first time period and the inductance current is smaller than 0;

turning on the second switch when the capacitor voltage is a second voltage and the inductance current is smaller than 0; and turning off the second switch when the second switch is turned on for a second time period and the inductance current is larger than 0, wherein the capacitor voltage decreases form the second voltage to the first voltage;

wherein, when the first switch is turned off, the capacitor voltage of the first capacitor can increase from the first voltage to the second voltage, the first node voltage of the first node can decrease from the second voltage to the first voltage and when the second switch is turned off, the capacitor voltage of the first capacitor can decrease from the second voltage to the first voltage, the first node voltage of the first node can increase from the first voltage to the second voltage.

23. The method according to claim 22, wherein the magnitude of the first voltage is zero.

24. The method according to claim 22, wherein the magnitude of the second voltage is equaled to the driving voltage applied by the power source.

25. The method according to claim 22, wherein the first capacitor further includes a first side coupled to the drain electrode of the first switch and a second side coupled to the source electrode of the first switch, and the capacitor voltage is defined to be the difference between the electrical potential of the first side and the electrical potential of the second side.

26. The method according to claim 22, wherein the first node voltage is defined to be the difference between the electrical potential of the first node and the electrical potential of the second node.

27. The method according to claim 22, wherein the inductance current of the first inductance is defined to be positive when the inductance current flows from the second node to the first node.

28. The method according to claim 22, wherein the inductance current of the first inductance is defined to be negative when the inductance current flows from the first node to the second node.

29. The method according to claim 22, wherein the capacitor voltage of the first capacitor is the first voltage and the first node voltage of the first node is the second voltage in the first time period.

30. The method according to claim 22, wherein the capacitor voltage of the first capacitor is the second voltage and the first node voltage of the first node is the first voltage in the second time period.

* * * * *